US005608500A

United States Patent [19]

Funabashi et al.

[11] Patent Number: 5,608,500

[45] Date of Patent: Mar. 4, 1997

[54] CONTACT CHARGING MEMBER AND ELECTROPHOTOGRAPHIC APPARATUS USING THE SAME

[75] Inventors: Eiji Funabashi, Kanagawa-ken; Shuichi Aita, Yokohama, both of Japan

[73] Assignee: Canon Kabushiki Kaisha, Tokyo, Japan

[21] Appl. No.: 623,372

[22] Filed: Mar. 28, 1996

[30] Foreign Application Priority Data

Mar. 29, 1995 [JP] Japan ..... 7-071810

[51] Int. Cl.[6] ..... G03G 15/02; G03G 15/00

[52] U.S. Cl. ..... 399/176; 361/225

[58] Field of Search ..... 355/219; 361/225

[56] References Cited

U.S. PATENT DOCUMENTS 5,017,965 5/1991 Hashimoto et al. ..... 355/219

5,363,176 11/1994 Ishihara et al. ..... 355/219

*Primary Examiner*—Joan H. Pendegrass

*Assistant Examiner*—Quana Grainger

*Attorney, Agent, or Firm*—Fitzpatrick, Cella, Harper & Scinto

[57] ABSTRACT

A contact charging member is used in a charging device for charging an image carrier by contacting the contact charging member to which a voltage is impressed with the image carrier. The contact charging member has at least a supporting member and a coating member. The coating member is a seamless tube consisting of a resin blend of a flexible resin and a heat resistant resin.

15 Claims, 3 Drawing Sheets

CONTACT CHARGING MEMBER AND ELECTROPHOTOGRAPHIC APPARATUS USING THE SAME

BACKGROUND OF THE INVENTION

1. Field of the Invention

The present invention relates to a charging member for charging a material to be charged by contacting the charging member to which a voltage is impressed to the material, and the method of the manufacture thereof, and an electrophotographic apparatus using the charging member.

2. Related Background Art

In image forming apparatuses such as an electrophotographic apparatus (e.g. a copying machine and a printer), and an electrostatic recorder, a corona discharging device, which is a non-contact charging system, has conventionally been used as a charging means for image carriers such as electrophotographic photosensitive members and electrostatic-recording dielectrics, which are materials to be charged.

Although the corona discharging device has advantages such as excellent uniformity of charging, it requires an expensive high voltage source. It also requires a large space for itself and for shielding the high-voltage source. It produces a relatively large quantity of products formed by corona, such as ozone, which require additional means and mechanisms for the treatment of such products, leading to increasing in equipment size and cost.

Recently, charging means using a contact charging system has been used instead of corona charging devices. Contact charging is used for charging the surface of a material to be charged to a predetermined polarity and potential by contacting a charging member to which a voltage is impressed with a material to be charged, and can lower the voltage of the power source. Contact charging has such advantages as decrease in the quantity of products formed by corona, and the simplification and cost reduction of the equipment.

A contact charging member is generally formed by the following methods:

A) A method in which a conductive elastic layer is formed along a metallic conductive base material (core metal), and the conductive elastic layer is in turn coated with a thin resistive layer and a thin surface layer along the periphery thereof by dipping or roll coating.

B) A method in which a seamless tube is formed from a fluorinated resin, utilizing its non-adhesive and non-contaminating properties, the inner diameter of the seamless tube is formed to be smaller than the thickness of the conductive elastic layer, and the conductive elastic layer is pushed in the seamless tube; or a method in which a shrinking (heat shrinking) seamless tube formed from a fluorinated resin, which is heated to shrink and form a surface layer.

However, the method A) has the following problems:

1) Since the material for each layer must be dissolved in an organic solvent to form a paint, the material type is limited. (Unless the solubility factor of each layer is changed, the layers dissolve each other and the operation of the layers are degraded.)

2) Since the lower layer (resistive layer) is dried before the upper layer is applied and dried, productivity is low.

3) Since solubility factors differ, the adhesion of each layer is low, and may cause floating or wrinkles to occur.

Also, since a primer is often used for improving adhesion, the costs are elevated.

4) The thickness of each layer is uneven, and it is difficult to finish the surface to be flat and smooth.

5) Especially when a foamed material is used for a supporting member, the image is affected by the unevenness of the surface causing defective images.

The method B) also has the following problems:

1) It is difficult to disperse conductive pigments uniformly in a fluorinated resin.

2) The fluorinated resin itself is expensive.

3) Since the fluorinated resin has poor adhesion properties, the internal surface of the tube must be etched, resulting in high costs.

4) Since the fluorinated resin is hard, the surface hardness of the charging roller becomes high, and the developer may be fused on the surface of the photosensitive member.

5) Since the fluorinated resin is difficult to undergo elastic deformation, the tube may break or become eccentric due to a large force produced on joining.

SUMMARY OF THE INVENTION

It is an object of the present invention to provide a contact charging member which is easy to manufacture, excels in surface smoothness, and can form high-quality images.

It is another object of the present invention to provide an electrophotographic apparatus using such a contact charging member.

The present invention is a contact charging member used in a charging device for charging an image carrier by contacting a charging member to which a voltage is impressed with the image carrier, in which the charging member has at least a supporting member and a coating member, the coating member being a seamless tube made of a resin blend of a flexible resin and a heat-resistant resin.

A property required for a contact charging member for charging an image carrier by contacting with the image carrier is elasticity. This is for maintaining a constant nip width with the surface of the image carrier, and for not causing the developer to be fused on the surface of the image carrier. Therefore, an elastic material is used for the supporting member, and the surface member forming the periphery of the supporting member must be flexible for not causing the developer to be fused on the image carrier.

Another required property is heat resistance for not causing defective images due to deformation in a high temperature atmosphere (temperature rise in the machine) used under the condition of making the supporting member contact with the surface of the image carrier at a constant pressure. That is, the supporting member must possess conflicting properties of flexibility on the one side and heat resistance on the other.

According to the present invention, since the seamless tube constituting the coating member of the contact charging member consists of two types of resins, flexible and heat resistant, a contact charging member having both flexibility and heat resistance, is provided. As the result, the nip width between the contact charging member and the surface of the image carrier can be formed, and stabilized charging properties can be obtained. Moreover, the fusion of the developer on the image carrier is prevented, and stable images can be obtained for a long period. Also, this seamless tube forms high-quality images with excellent surface smoothness.

DETAILED DESCRIPTION OF THE PREFERRED EMBODIMENTS

Figure 1:
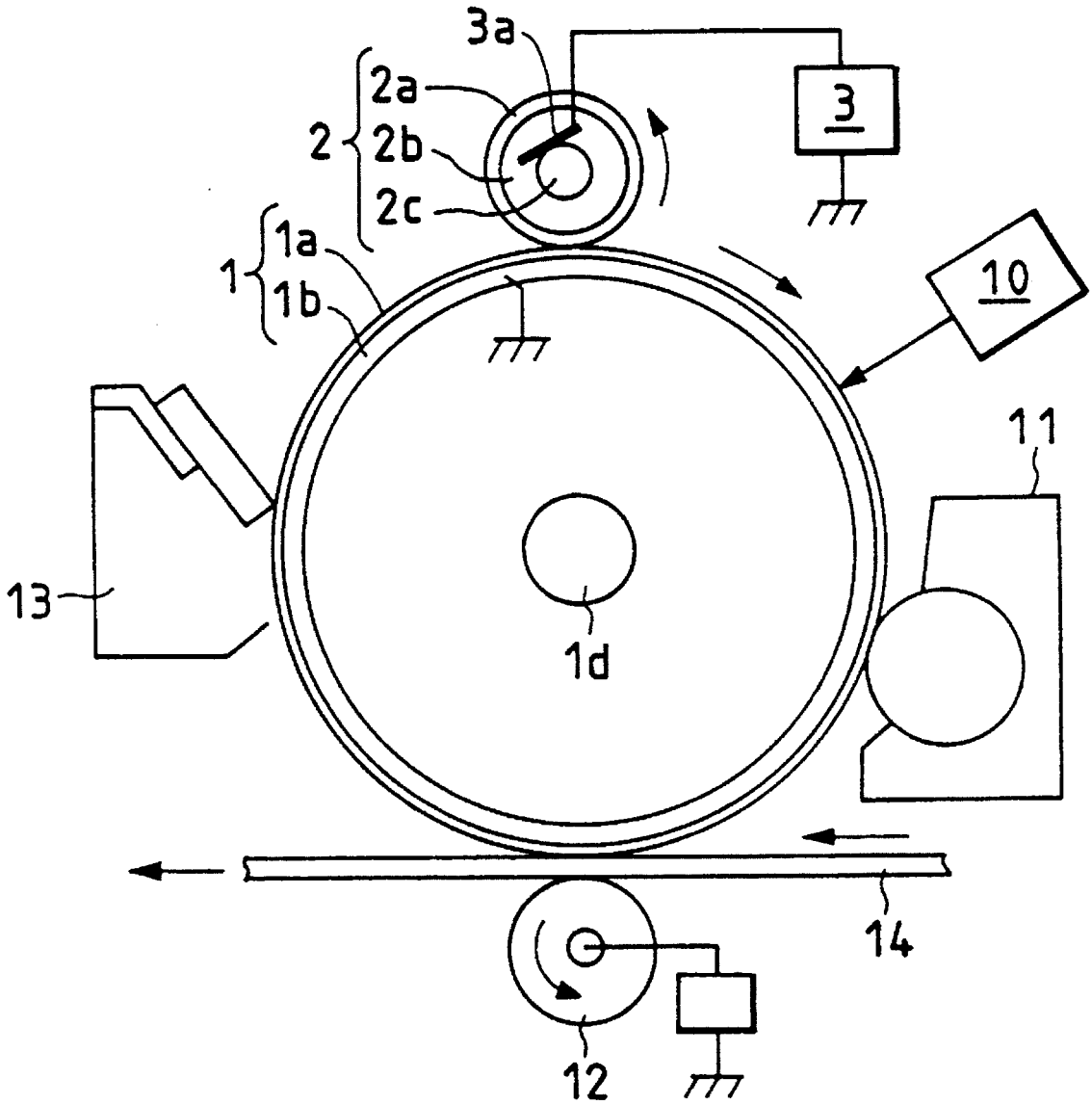
FIG. 1 PRIOR ART
FIG. 1 is a schematic diagram showing an ordinary transfer-type electrophotographic apparatus using a contact charging member of the present invention.

The contact charging member of the present invention comprises at least a supporting member and a coating member, and as described above, the supporting member must be formed of an elastic material, preferably a rubber material because of its elasticity recovery.

In order to make rubber exert its elasticity, several additives such as oil, plasticizer, and vulcanized agent must be added to the rubber material. In the case that the image carrier is composed of an organic photosensitive member, the surface of the image carrier is formed of an amorphous resin such as polyacrylate resin or polycarbonate resin for securing light transmission. Therefore, the surface of the image carrier is often contaminated and degraded due to the leakage of various additives added to the rubber material, causing defective images.

It is therefore preferred that the coating member not only has a function to prevent the leakage of the additives, but also does not contain components which may contaminate the surface of the image carrier. As described above, the object of the present invention is achieved by using a material which has both certain flexibility and heat resistance.

The inventors found that the requirements for the base polymer forming the seamless tube as the coating member were satisfied by the use of a resin blend produced by combining a flexible resin and a heat-resistant resin.

The flexible resins used in the present invention are selected from a group consisting of elastomers and modified elastomers formed of polymers or copolymers such as ethylene-propylene copolymer, ethylene-vinyl acetate copolymer, ethylene-ethyl acrylate copolymer, ethylene-methyl acrylate copolymer, styrene-butadiene copolymer, polyester, polyurethane, and polyamide. These flexible resins have a hardness A, specified in JIS-A (Japanese Industrial Standards), of preferably 80 degrees or less, and more preferably 70 degrees or less.

Since a polymer of a low hardness can be obtained from a copolymer of an aromatic vinyl compound and a diene by controlling their copolymerization ratio, it is preferably used as the seamless tube of the contact charging member of the present invention. Examples of aromatic vinyl compounds include styrene, p-chlorostyrene, vinyl toluene, and vinyl naphthalene. In particular, a styrene-based monomer is preferably used as an aromatic vinyl compound, and more preferably styrene is used. In this case, the content of styrene is preferably 50% by weight or less, and more preferably 30% by weight or less.

Although any dienes may be used if it forms a copolymer with an aromatic vinyl compound, butadiene and isoprene are preferably used for obtaining a polymer of a low hardness.

Furthermore, it is particularly preferred to use a polymer formed by adding hydrogen to a copolymer of an aromatic vinyl compound and a diene, because unsaturated bonds in the diene-based copolymer is eliminated by the addition of hydrogen, and degradation or other damages due to moisture or ozone are minimized.

On the other hand, a heat resistant resin is selected for a group consisting of resins and copolymers such as polyethylene, polypropylene, polyesters, polyethers, polyamides, polycarbonate, polyacetal, acrylonitrile-butadiene-styrene copolymer, polystyrene, polyurethane, polyphenylene oxide, polyvinyl acetate, polyvinylidene fluoride, and polytetrafluoroethylene. The heat resistant resin is selected to have a heat distortion temperature of 80° C. or higher measured in accordance with ASTM-D648.

Among these materials, polyolefines excel in the miscibility with the copolymer of an aromatic vinyl compound and a diene, in particular with the copolymer of styrene monomer and a diene. Especially, the resin with a low moisture absorption selected from a group consisting of polypropylene, polyethylene, and propylene-ethylene copolymer, as well as copolymers containing polypropylene or polyethylene is the most suitable.

The resulting seamless tube has a hardness A, specified in JIS-A, of preferably 80 degrees or less, and more preferably 70 degrees or less, and a heat distortion temperature of preferably 70° C. or higher measured in accordance with ASTM-D648.

Although the blend of two or more polymers is determined by the miscibility of the blend, the use of a polymer-type miscibility agent may be preferred considering the case where the miscibility of the two (or several) polymers.

As the miscibility agent used here, generally used surface active agents or coupling agents may not be able to use because these may contaminate or degrade the surface of the image carrier as described above. The preferred miscibility agents are polymer-type miscibility agents, such as a graft copolymer of a polyolefine and a vinyl polymer, or a block polymer consisting of the combination of vinyl polymers.

Selected two or more resins and a suitable polymer-type miscibility agent are mixed to form a resin blend.

The seamless tube used in the contact charging member of the present invention may contain an insulating filler. The insulating fillers used here include calcium carbonate, talc, clay, kaolin, mica, and magnesium oxide. Although these are generally blended for improving surface adhesion, the use of these insulating fillers also improve the breakdown voltage of the polymer.

The contact charging member of the present invention is used for charging the surface of an image carrier by contacting with the image carrier and impressing a voltage.

Consequently, the electrical resistance of the contact charging member must be adjusted to within the range between the lower limit of resistance which prevents the concentration of current generated on charging (discharging) even when defects (pinholes) are present on the surface of the image carrier, preferably $10^5$ Ωcm or higher, and the upper limit of resistance which prevents the occurrence of defective charging due to voltage drop in the contact charging member, preferably $10^{12}$ Ωcm or lower.

The contact charging member of the present invention comprises at least a supporting member and a coating member, and although the supporting member may have a resistance lower than $10^5$ Ωcm, the coating member cannot perform its function unless electrical resistance is within the above range. Therefore, it is preferred to adjust the electrical resistance of the seamless tube used as the surface layer member by using suitable conductive pigments (conductive carbon, conductive tin oxide, conductive titanium oxide, copper, silver, aluminum, nickel, cobalt, iron powder, etc.). In this case, also, two or more electroconductive pigments may be used in combination in order to obtain a desired electrical resistance.

A seamless tube is formed of the resin blend of which electrical resistance has been adjusted, and is fitted on the periphery of the supporting member to form a desired contact charging member. For the formation of the seamless tube, the use of extrusion or inflation which is effective for improving surface smoothness is preferred.

The seamless tube may be either a non-heat-shrinking thin tube or a heat-shrinking thin tube produced by a known method.

The thickness of the seamless tube is preferably 1 mm or less, more preferably 500 μm or less, and most preferably 300 μm or less. If the seamless tube is extremely thick, its hardness increases resulting in difficulty of adhesion with the surface of the image carrier, and the fusion of the developer on the surface.

The contact charging member of the present invention comprises at least a supporting member and a coating member, and the supporting member comprises a solid or foamed material formed on the periphery of the core metal. If the supporting member comprises a foamed material, oscillation depending on the frequency of the alternating current voltage is absorbed by the foamed material preventing the transfer of oscillation to the image carrier even when an oscillating electric field (an alternating current voltage is overlapped on a direct current voltage) is impressed, and a high-frequency noise (so-called charging noise) generated on charging operation may be minimized. When the supporting member is formed of a foamed material, if the coating member is formed by dipping, it is difficult to form a uniform coating layer due to the evaporation of the solvent or the effect of the surface configuration of the supporting member, while the use of the seamless tube improves the surface characteristics resulting in a satisfactory results.

When the seamless tube is non-heat-shrinking, the inner diameter of the tube is designed to be smaller than the outer diameter of the supporting member, and after the inner diameter of the tube is expanded by blowing air into the tube, the supporting member is inserted into the tube to fit the supporting member in the tube utilizing the shrinking force of the tube.

When the seamless tube is heat-shrinking, the inner diameter of the tube is designed to be larger than the outer diameter of the supporting member, and after the supporting member is inserted into the tube, the tube is heated and shrunk to fit the supporting member in the tube. In either case, adhesion of the supporting member and the tube may be enhanced by applying a conductive adhesive on the external surface of the supporting member or the internal surface of the seamless tube.

The voltage impressed on the contact charging member may be either an oscillating electric field (an alternating current voltage is overlapped on a direct current voltage) or a direct current voltage alone, and the surface of the image carrier is uniformly charged by the contact charging member.

Also, in order to eliminate the effect of the surface roughness of the supporting member and the uneven resistance of the supporting member, and to secure constant power supply to the coating member, an electroconductive layer for the supporting and coating members may be provided.

The electroconductive layer used here is formed around the periphery of the supporting member by a method wherein an electroconductive material is applied in the form of a paint, or a conductive seamless tube is formed and fitted.

In this case, the resistivity of the electroconductive layer is preferably $1\times10^5$ Ωcm or less.

Although the material properties of the electroconductive layer is not limited, when an electroconductive material is applied in the form of a paint, solvent which may dissolve the supporting member must be avoided.

On the other hand, when a conductive seamless tube is used, the material is selected from a group consisting of elastomers and modified elastomers formed of resins or copolymers such as ethylene-propylene copolymer, ethylene-vinyl acetate copolymer, ethylene-ethyl acrylate copolymer, ethylene-methyl acrylate copolymer, styrene-butadiene copolymer, polyester, polyurethane, and polyamide. Since the tube is required to have a certain elasticity, it has a hardness A, specified in JIS-A (Japanese Industrial Standards), of preferably 90 degrees or less.

The conductive seamless tube may be a non-heat-shrinking thin tube, or a heat-shrinking thin tube, and its thickness is 1 mm or less, preferably 500 μm or less, and more preferably 300 μm or less.

FIG. 1 shows an example of the electrophotographic apparatus suitable for adopting the contact charging member of the present invention.

In FIG. 1, 1 indicates a photosensitive member used as the work piece to be charged, and in this example, it is a drum-type electrophotographic photosensitive member basically comprising a conductive supporting member 1*b*, such as aluminum, and a photosensitive layer 1*a* formed around the periphery of the supporting member 1*b*. The photosensitive member 1 is rotated clockwise (on the diagram) around the axis 1*d* at a certain circumferential speed.

In FIG. 1, 2 indicates a roller-type charging member which contacts with the photosensitive member 1, and charges the surface of the photosensitive member 1 uniformly to a desired polarity and potential. The charging member 2 comprises a supporting member consisting of a core metal 2*c*, and an elastic layer 2*b* formed around the periphery of the core metal 2*c*, and a coating member 2*a* formed around the periphery of the elastic layer 2*b*. The both ends of the core metal 2*c* are rotatably held by a bearing member (not shown), placed in parallel to the drum-type photosensitive member 1 pushed to the surface of the photosensitive member by a pushing means such as a spring (not shown) at a predetermined pressure, and rotated synchronizing the rotation of the photosensitive member 1.

When a predetermined DC bias or DC+AC bias from the power source 3 is impressed to the core metal 2*c*, the circumferential surface of the rotating photosensitive member 1 is contact-charged to desired polarity and potential.

The photosensitive member 1 which has been uniformly charged by the charging member 2 is then subjected to the exposure of objective image information (laser beam scanning exposure, the slit exposure of original images, etc.) by the exposure means 10 to form electrostatic latent images corresponding to the objective image information on the circumferential surface.

The latent images are then developed by the developing means 11 sequentially to form visible toner images.

These toner images are then transferred sequentially by the transferring means 12 from the paper feed means (not shown) on to the surface of the transferring material 14 conveyed to the transferring location between the photosensitive member 1 and the transferring means 12 at an adequate timing synchronized to the rotation of the photosensitive member 1. The transferring means 12 of this example is a transferring roller, and the toner images on the surface of the photosensitive member 1 are transferred on to the surface of the transferring material 14 by charging from the back side of the transferring material 14 to the polarity opposite from the polarity of the toner.

The transferring material 14 on which toner images have been transferred is separated from the photosensitive member 1, and conveyed to the fixing means (not shown), where the images are fixed, and output as complete images.

The surface of the photosensitive member 1 after image transferring is cleaned by the cleaning means 13 by removing contaminants such as remaining toner, and is used for image making repeatedly.

In the present invention, as FIG. 1 shows, a plurality of elements of an electrophotographic apparatus such as the photosensitive member, the charging member, the developing means and cleaning means may be integrated into a process cartridge. By this the process cartridge may be attached to or detached from the main body of the apparatus. For example, an elastic member of the present invention used as the charging member, and at least one of the developing means and the cleaning means as required are integrated with the photosensitive member into a process cartridge to constitute detachably using a guide means such as the rails on the main body of the apparatus.

The charging member of the present invention may be used for image transferring, primary charging, discharging, as well as conveying such as the paper feed roller.

Electrophotographic apparatuses which can use the charging member of the present invention include such apparatuses for electrophotographic applications as copiers, laser-beam printers, LED printers, and electro-photoengraving systems.

EXAMPLE 1

A semiconductive polymer alloy was prepared by combining 50% by weight of a hydrogen-added styrene-butadiene elastomer (JIS hardness A: 40 degrees, heat distortion temperature, ASTM-D648: 60° C.), 40% by weight of polypropylene (heat distortion temperature, ASTM-D648: 110° C.), and 10% by weight of conductive carbon, and melting and kneading the mixture using a pressurized kneader at 180° C. for 10 minutes. The resultant semiconductive polymer alloy had a volume resistivity of $2\times10^8$ Ωcm, a JIS hardness A of 60°, and a heat distortion temperature (ASTM-D648) of 80° C.

The semiconductive polymer alloy obtained was extruded by extruder to form a seamless tube having an inner diameter of 10 mm, a thickness of 200 μm, and a length of 250 mm.

Separately, a supporting member was fabricated by applying to the external surface of a core metal (stainless steel, 6 mm dia.) and vulcanizing an EPDM foam, having a volume resistivity of $5\times10^4$ Ωcm and a thickness of 3 mm, prepared by combining 15% by weight of conductive carbon, and appropriate amounts of a foaming agent and foaming additive.

Figure 2:
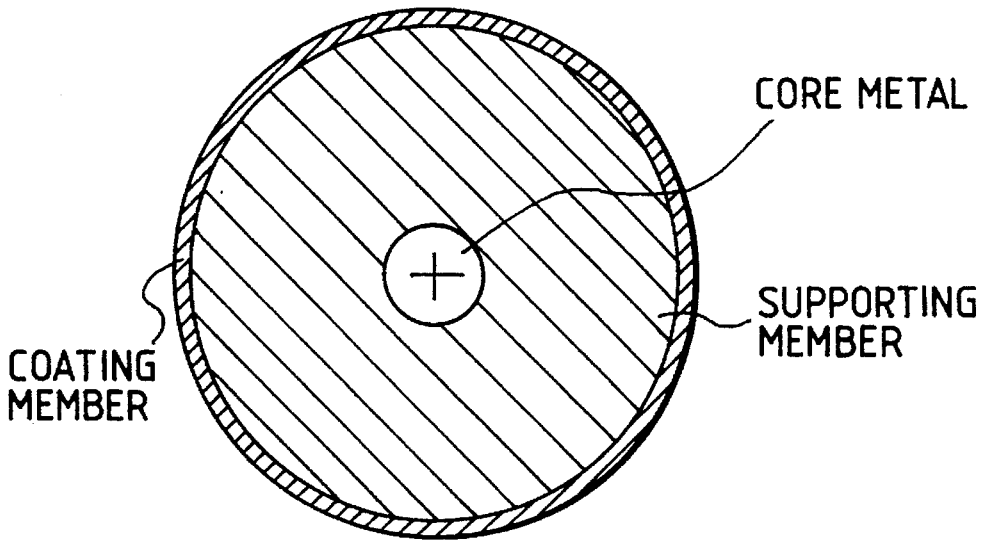
FIG. 2 is a schematic sectional view showing a contact charging member of the present invention.

Then, air was blown into the seamless tube, which had been formed, to expand the outer diameter, and the supporting member was inserted into the seamless tube to form a charging member as shown in FIG. 2.

The resultant charging member has the following properties:

Resistance: $2\times10^8$ Ωcm

Surface hardness: 60° (JIS-A)

Surface average roughness: 0.08 μm (center line average roughness Ra in accordance with JIS B0601)

Compressive permanent strain: 7% (JIS-K6301, 70° C., 22 hrs, 25% RH)

Figure 4:
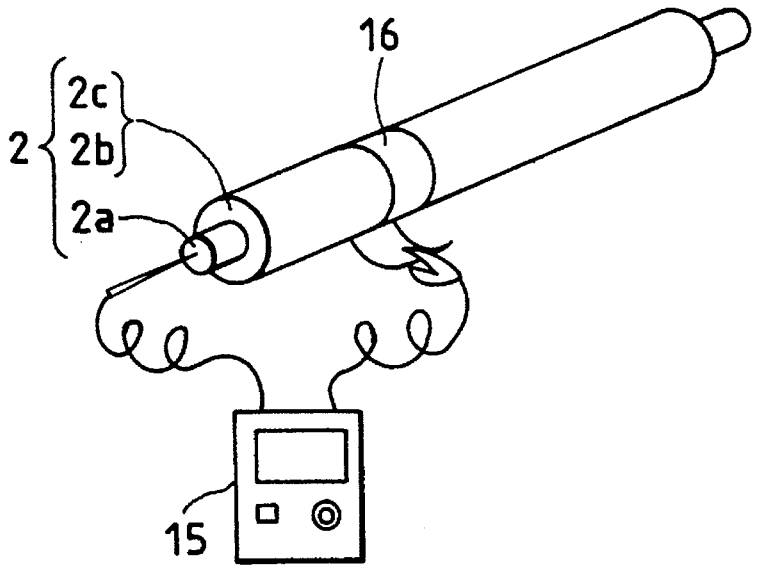
FIG. 4 is a schematic sectional view showing a contact charging member of the present invention.

The above resistance was measured by the method as shown in FIG. 4.

FIG. 4 is a diagram illustrating the method for measuring the resistance of the charging roller. An aluminum electrode 16 is installed on the external surface of the charging roller 2, and resistance between the electrode 16 and the core metal 2*a* of the charging roller 2 is measured using a resistivity meter 15. The voltage impressed is 250 volts.

Figure 3:
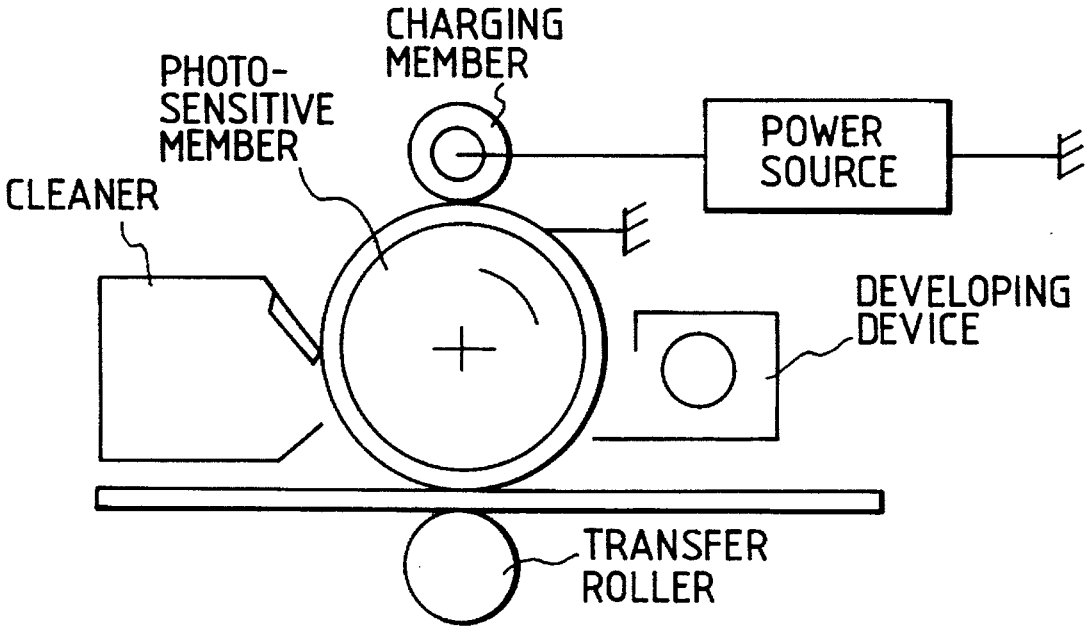
FIG. 3 is a schematic sectional view showing an electrophotographic printer using a contact charging member of the present invention.

The charging member 2 was placed at the location of the primary charger of the cartridge for the electrophotographic printer shown in FIG. 3 so that the contacting pressure with the image carrier (photosensitive member) became 10 g (force measured when an aluminum sheet of a width of 1 cm was inserted between the photosensitive member and the charging roller, and was pulled out), and a DC voltage of −670 volts and an AC voltage of 2 kilovolts at a frequency of 470 Hz were simultaneously impressed, and durability for 6,000 sheets was evaluated under a standard condition (temperature: 23° C., relative humidity: 55%), a high-temperature high-humidity condition (temperature: 32.5° C., relative humidity: 80%), and a low-temperature low-humidity condition (temperature: 15° C., relative humidity: 10%).

The results showed that change in the quality of images between before and after the durability test was negligible under all conditions, and no fusion of the developer on the surface of the image carrier was found.

Furthermore, the same charging member was installed in a new cartridge, and the same test was repeated for three times under each condition. In this test also, change in the quality of images between before and after the durability test was negligible under all conditions, and no fusion of the developer on the surface of the image carrier was found.

EXAMPLE 2

A semiconductive polymer alloy was prepared by combining 50% by weight of a hydrogen-added styrene-butadiene elastomer (JIS hardness A: 40 degrees, heat distortion temperature, ASTM-D648: 60° C.), 40% by weight of an ethylene-vinyl acetate copolymer (heat distortion temperature, ASTM-D648: 100° C.), and 10% by weight of conductive carbon, and melting and kneading the mixture using a pressurized kneader at 180° C. for 10 minutes. The resultant semiconductive polymer alloy had a volume resistivity of $2\times10^8$ Ωcm, a JIS hardness A of 60°, and a heat distortion temperature (ASTM-D648) of 80° C.

The semiconductive polymer alloy obtained was extruded by extruder to form a seamless tube having an inner diameter of 10 mm, a thickness of 200 μm, and a length of 250 mm.

Separately, a supporting member was fabricated by applying to the external surface of a core metal (stainless steel, 6 mm dia.) and vulcanizing an EPDM foam, having a volume resistivity of $5\times10^4$ Ωcm and a thickness of 3 mm, prepared by combining 15% by weight of conductive carbon, and appropriate amounts of a foaming agent and foaming additive.

Then, air was blown into the seamless tube, which had been formed, to expand the outer diameter, and the supporting member was inserted into the seamless tube to form a charging member as shown in FIG. 2.

The resultant charging member has the following properties:

Resistance: $5\times10^8$ Ωcm

Surface hardness: 55° (JIS-A)

Surface average roughness: 0.09 μm

Compressive permanent strain: 8% (JIS-K6301, 70° C., 22 hrs, 25% RH)

The charging member 2 was placed at the location of the primary charger of the cartridge for the electrophotographic printer shown in FIG. 3 so that the contacting pressure with the image carrier (photosensitive member) became 10 g, and a DC voltage of −670 volts and an AC voltage of 2 kilovolts at a frequency of 470 Hz were simultaneously impressed, and durability for 6,000 sheets was evaluated under a standard condition, a high-temperature high-humidity condition, and a low-temperature low-humidity condition.

The results showed that change in the quality of images between before and after the durability test was negligible under all conditions, and no fusion of the developer on the surface of the image carrier was found.

EXAMPLE 3

A semiconductive polymer alloy was prepared by combining 40% by weight of a hydrogen-added styrene-isoprene elastomer (JIS hardness A: 40 degrees, heat distortion temperature, ASTM-D648: 60° C.), 20% by weight of a block copolymer of polypropylene and polyethylene (heat distortion temperature, ASTM-D648: 110° C.), 20% by weight of polyurethane (heat distortion temperature, ASTM-D648: 100° C.), 10% by weight of a miscibility agent consisting of a block copolymer of ethylene-vinyl acetate and polystyrene, and 10% by weight of conductive carbon, and melting and kneading the mixture using a pressurized kneader at 200° C. for 10 minutes. The resultant semiconductive polymer alloy had a volume resistivity of $5\times10^7$ Ωcm, a JIS hardness A of 65°, and a heat distortion temperature (ASTM-D648) of 95° C.

The semiconductive polymer alloy obtained was extruded by extruder to form a seamless tube having an inner diameter of 10 mm, a thickness of 200 μm, and a length of 250 mm.

Separately, a supporting member was fabricated by applying to the external surface of a core metal (stainless steel, 6 mm dia.) and vulcanizing an EPDM foam, having a volume resistivity of $5\times10^4$ Ωcm and a thickness of 3 mm, prepared by combining 15% by weight of conductive carbon, and appropriate amounts of a foaming agent and foaming additive.

Then, air was blown into the seamless tube, which had been formed, to expand the outer diameter, and the supporting member was inserted into the seamless tube to form a charging member as shown in FIG. 2.

The resultant charging member has the following properties:

Resistance: $5\times10^7$ Ωcm

Surface hardness: 65° (JIS-A)

Surface average roughness: 0.10 μm

Compressive permanent strain: 5% (JIS-K6301, 70° C., 22 hrs, 25% RH)

The charging member 2 was placed at the location of the primary charger of the cartridge for the electrophotographic printer shown in FIG. 3 so that the contacting pressure with the image carrier (photosensitive member) became 10 g, and a DC voltage of −670 volts and an AC voltage of 2 kilovolts at a frequency of 470 Hz were simultaneously impressed, and durability for 6,000 sheets was evaluated under a standard condition, a high-temperature high-humidity condition, and a low-temperature low-humidity condition.

The results showed that change in the quality of images between before and after the durability test was negligible under all conditions, and no fusion of the developer on the surface of the image carrier was found. In this example, the same results were obtained when a silicone rubber foam was used in place of the EPDM foam.

EXAMPLE 4

A semiconductive polymer alloy was prepared by combining 60% by weight of a hydrogen-added styrene-butadiene elastomer (JIS hardness A: 40 degrees, heat distortion temperature, ASTM-D648: 60° C.), 20% by weight of polypropylene (heat distortion temperature, ASTM-D648: 110° C.), 10% by weight of conductive carbon, and 10% by weight of magnesium oxide powder (average particle size: 1.5 μm), and melting and kneading the mixture using a pressurized kneader at 180° C. for 10 minutes. The resultant semiconductive polymer alloy had a volume resistivity of $5\times10^7$ Ωcm, a JIS hardness A of 65°, and a heat distortion temperature (ASTM-D648) of 85° C.

The semiconductive polymer alloy obtained was extruded by extruder to form a seamless tube having an inner diameter of 10 mm, a thickness of 200 μm, and a length of 250 mm.

Separately, a supporting member was fabricated by applying to the external surface of a core metal (stainless steel, 6 mm dia.) and vulcanizing an EPDM foam, having a volume resistivity of $5\times10^4$ Ωcm and a thickness of 3 mm, prepared by combining 15% by weight of conductive carbon, and appropriate amounts of a foaming agent and foaming additive.

Then, air was blown into the seamless tube, which had been formed, to expand the outer diameter, and the supporting member was inserted into the seamless tube to form a charging member as shown in FIG. 2.

The resultant charging member has the following properties:

Resistance: $8\times10^8$ Ωcm

Surface hardness: 45° (JIS-A)

Surface average roughness: 0.20 μm

Compressive permanent strain: 10% (JIS-K6301, 70° C., 22 hrs, 25% RH)

Although the resultant charging member has a low hardness, little adhesiveness of the surface was found due to the effect of magnesium oxide.

Ten holes each having a diameter of 0.5 mm and reaching the metal base material were formed on the image carrier (photosensitive member) using a metal needle, made the image carrier contact with the charging member at the same contact force as in Example 1, and a DC voltage of −2,000 volts was impressed under a high-temperature, high-humidity condition, but no concentration of current (so-called pinhole leakage) was found.

Furthermore, the durability for 6,000 sheets was evaluated under various conditions as in Example 1.

The results showed that change in the quality of images between before and after the durability test was negligible under all conditions, and no fusion of the developer on the surface of the image carrier was found. In this example, the same results were obtained when a urethane rubber foam was used in place of the EPDM foam.

EXAMPLE 5

The polymer alloy prepared in Example 1 was extruded by extruder to form a seamless tube having an inner diameter of 8 mm, a thickness of 300 μm, and a length of 250 mm. After sufficiently cooled, the seamless tube was heated to 70° C., and air was blown into the tube for stretching the tube to an inner diameter of 14 mm to form a heat-shrinking seamless tube.

Separately, a supporting member was fabricated by applying to the external surface of a core metal (stainless steel, 6 mm dia.) and vulcanizing an EPDM foam, having a volume resistivity of $5\times10^4$ Ωcm and a thickness of 3 mm, prepared by combining 15% by weight of conductive carbon. The resultant supporting member was coated with a conductive adhesive of a thickness of 1 μm.

Then, the supporting member was inserted into the above heat-shrinking seamless tube, and heated to 130° C. for 10 minutes to adhere the tube with the supporting member to form the charging member.

The resultant charging member has the following properties:

Resistance: $5\times10^7$ Ωcm

Surface hardness: 65° (JIS-A)

Surface average roughness: 0.06 μm

Compressive permanent strain: 7% (JIS-K6301, 70° C., 22 hrs, 25% RH)

The charging member 2 was placed at the location of the primary charger of the cartridge for the electrophotographic printer shown in FIG. 3 so that the contacting pressure with the image carrier (photosensitive member) became 10 g, and a DC voltage of −670 volts and an AC voltage of 2 kilovolts at a frequency of 470 Hz were simultaneously impressed, and durability for 6,000 sheets was evaluated under a standard condition, a high-temperature high-humidity condition, and a low-temperature low-humidity condition.

The results showed that change in the quality of images between before and after the durability test was negligible under all conditions, and no fusion of the developer on the surface of the image carrier was found.

EXAMPLE 6

A semiconductive polymer was prepared by combining 90% by weight of a urethane elastomer (JIS hardness A: 80 degrees), and 10% by weight of conductive carbon, and melting and kneading the mixture using a pressurized kneader at 180° C. for 10 minutes. The resultant conductive polymer, having a volume resistivity of $5\times10^3$ Ωcm, was extruded by extruder to form a seamless tube having an inner diameter of 10 mm, a thickness of 150 μm, and a length of 250 mm.

Figure 5:
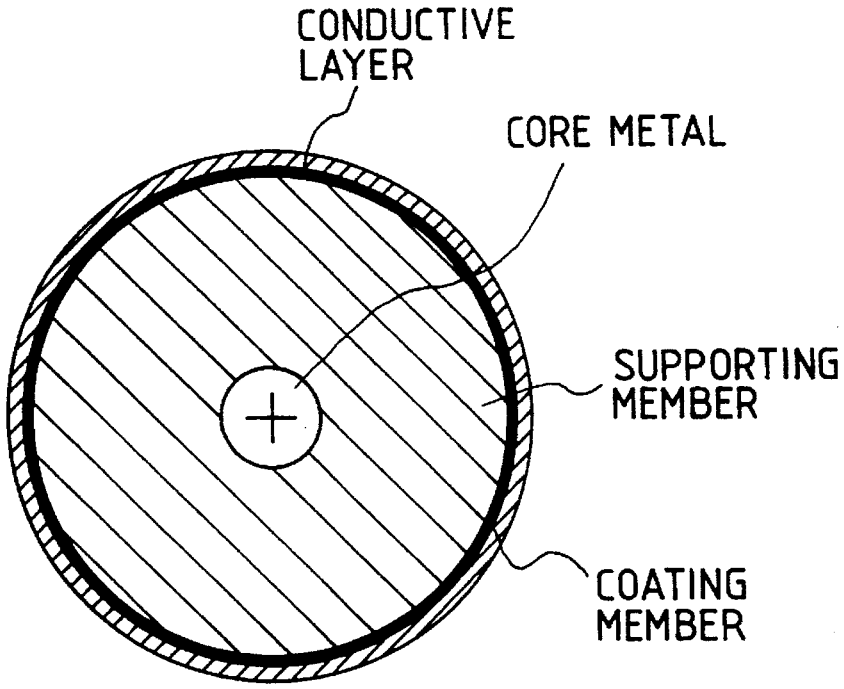
FIG. 5 is an explanatory diagram illustrating the resistance measurement of the contact charging member.

Then, air was blown into the conductive tube, to expand the outer diameter, and the supporting member comprising an EPDM foam formed in Example 1 was inserted into the conductive tube to form an electroconductive layer. Then, air was blown into the semiconductive tube formed in Example 1 to expand the outer diameter of the tube, and the supporting member coated with the conductive tube was inserted to form the charging member as shown in FIG. 5.

The resultant charging member has the following properties:

Resistance: $2\times10^8$ Ωcm

Surface hardness: 58° (JIS-A)

Surface average roughness: 0.08 μm

Compressive permanent strain: 6% (JIS-K6301, 70° C., 22 hrs, 25% RH)

The charging member 2 was placed at the location of the primary charger of the cartridge for the electrophotographic printer shown in FIG. 3 so that the contacting pressure with the image carrier (photosensitive member) became 10 g (force measured when an aluminum sheet of a width of 1 cm was inserted between the photosensitive member and the charging roller, and was pulled out), and a DC voltage of −670 volts and an AC voltage of 1–2 kilovolts at a frequency of 470 Hz were simultaneously impressed, and initial image quality was evaluated under a low-temperature low-humidity condition (temperature: 15° C., relative humidity: 10%).

The results showed that the charging member fabricated in Example 1 required an AC voltage of 1.6 kilovolts for obtaining a uniform image without defective local charging, while the charging member having an intervening electroconductive layer required an AC voltage of 1.4 kilovolts for obtaining a uniform image.

EXAMPLE 7

Each of the charging members fabricated in Examples 1–6 was placed at the location of the primary charger of the cartridge for the electrophotographic printer shown in FIG. 3 so that the contacting pressure with the image carrier (photosensitive member) became 10 g, and a DC voltage of −670 volts and an AC voltage of 2 kilovolts at a frequency of 1,000 Hz were simultaneously impressed, and charging noise was measured in an anechoic room (noise pressure: 35 dB or below) using a noise meter.

The results showed that all the charging members generated noise of 50 dB or below.

EXAMPLE 8

Each of the charging members fabricated in Examples 1–6 was placed at the location of the primary charger of the cartridge for the electrophotographic printer shown in FIG. 3 so that the contacting pressure with the image carrier (photosensitive member) became 10 g, and only a DC voltage of −1,400 volts was impressed, and durability tests for 6,000 sheets were conducted under a standard condition.

The results showed that change in the quality of images between before and after the durability test was negligible, and no fusion of the developer on the surface of the image carrier was found.

COMPARATIVE EXAMPLE 1

A semiconductive polymer was prepared by combining 90% by weight of an elastomer consisting of ethylene and propylene (JIS hardness A: 90 degrees, heat distortion temperature, ASTM-D648: 60° C.), and 10% by weight of conductive carbon, and melting and kneading the mixture using a pressurized kneader at 180° C. for 10 minutes. The resultant semiconductive polymer had a volume resistivity of $2\times10^8$ Ωcm, a JIS-A hardness of 95°, and a heat distortion temperature in accordance with ASTM-D648 of 90° C.

The resultant semiconductive polymer was extruded by extruder to form a seamless tube having an inner diameter of 10 mm, a thickness of 200 μm, and a length of 250 mm.

Separately, a supporting member was fabricated by applying to the external surface of a core metal (stainless steel, 6 mm dia.) and vulcanizing an EPDM foam, having a volume resistivity of $5\times10^4$ Ωcm and a thickness of 3 mm, prepared by combining 15% by weight of conductive carbon and appropriate amounts of a foaming agent and a foaming additive.

Then, air was blown into the seamless tube, which had been formed, to expand the outer diameter, and the supporting member was inserted into the seamless tube to form the charging member as shown in FIG. 2.

The resultant charging member has the following properties:

Resistance: $2\times10^8$ Ωcm

Surface hardness: 85° (JIS-A)

Surface average roughness: 0.10 μm

Compressive permanent strain: 15% (JIS-K6301, 70° C., 22 hrs, 25% RH)

The charging member 2 was placed at the location of the primary charger of the cartridge for the electrophotographic printer shown in FIG. 3 so that the contacting pressure with the image carrier (photosensitive member) became 10 g, and a DC voltage of −670 volts and an AC voltage of 2 kilovolts at a frequency of 470 Hz were simultaneously impressed, and durability for 6,000 sheets was evaluated under a standard condition, a high-temperature, high-humidity condition, and a low-temperature low-humidity condition.

The results showed that the fusion of the developer on the surface of the image carrier was observed in all the conditions.

COMPARATIVE EXAMPLE 2

Twelve % by weight of conductive carbon was combined with perfluoroalkoxy resin (JIS-A hardness: 99 degrees or more, heat distortion temperature, ASTMD648: 180° C.), and the mixture was extruded by extruder to form a seamless tube having an outer diameter of 12 mm, a thickness of 200 μm, and a length of 250 mm.

Separately, a supporting member was fabricated by applying to the external surface of a core metal (stainless steel, 6 mm dia.) and vulcanizing an EPDM foam, having a volume resistivity of $5\times10^4$ Ωcm and a thickness of 3 mm, prepared by combining 15% by weight of conductive carbon. The surface of the resultant supporting member was coated with a conductive adhesive to a thickness of 1 μm.

Then air was blown into the seamless tube, which had been formed, to expand the outer diameter, and the supporting member was inserted into the seamless tube, and dried at 100° C. for 10 minutes for adhering the supporting member to the seamless tube to form a charging member.

The resultant charging member has the following properties:

Resistance: $8\times10^7$ Ωcm

Surface hardness: 90° (JIS-A)

Surface average roughness: 0.05 μm

Compressive permanent strain: 2% (JIS-K6301, 70° C., 22 hrs, 25% RH)

The charging member was placed at the location of the primary charger of the electrophotographic printer as the same manner as in examples so that the contacting pressure with the image carrier (photosensitive member) became 10 g, and a DC voltage of −670 volts and an AC voltage of 2 kilovolts at a frequency of 470 Hz were simultaneously impressed, and durability for 6,000 sheets was evaluated under a standard condition, a high-temperature, high-humidity condition, and a low-temperature low-humidity condition.

The results showed that good images could not be obtained because the contact pressure between the charging member and the image carrier, and the developer was fused on the surface of the image carrier in all the conditions.

COMPARATIVE EXAMPLE 3

A paint prepared by dissolving an alcohol-soluble nylon in methanol to a solid content of 10% by weight, and dispersing 30% by weight for the solid of conductive titanium oxide, having a viscosity of 150 cps was applied to the surface of each of supporting members comprising foams of Examples 1–4 using a dipping apparatus.

The average surface roughness of the resultant charging member was as large as 5 μm, and the smooth surface could not be obtained.

Then, only a DC voltage was impressed as in Example 7 and the durability test was conducted, but defective sandy images were obtained.

What is claimed is:

1. A contact charging member used in a charging device for charging an image carrier by contacting said contact charging member to which a voltage is impressed with said image carrier, said contact charging member comprising at least a supporting member and a coating member, said coating member being a seamless tube consisting of a resin blend of a flexible resin and a heat resistant resin.

2. A contact charging member according to claim 1, wherein said flexible resin has a hardness of 80 degrees or less, and said heat resistant resin has a heat distortion temperature of 80° C. or above.

3. A contact charging member according to claim 2, wherein said flexible resin has a hardness of 70 degrees or less.

4. A contact charging member according to claim 1, wherein said seamless tube has a hardness of 80 degrees or less, and a heat distortion temperature of 70° C. or above.

5. A contact charging member according to claim 2, wherein said flexible resin is a copolymer of an aromatic vinyl compound and a diene.

6. A contact charging member according to claim 5, wherein said aromatic vinyl compound is styrene monomer, and said diene is selected from a group consisting of butadiene and isoprene.

7. A contact charging member according to claim 2, wherein said flexible resin is a copolymer of an aromatic vinyl compound and a diene to which hydrogen is added.

8. A contact charging member according to claim 2, wherein said heat-resistant resin is a polyolefine.

9. A contact charging member according to claim 8, wherein said polyolefine is selected from a group consisting of polypropylene and polyethylene.

10. A contact charging member according to claim 1, further comprising a conductive layer placed between said supporting member and said coating member.

11. A contact charging member according to claim 1, wherein said supporting member is a foamed elastic material formed around the periphery of a core metal.

12. An electrophotographic apparatus comprising a contact charging member and an electrophotographic photosensitive member, wherein said charging member has at least a supporting member and a coating member, said coating member being a seamless tube consisting of a resin blend of a flexible resin and a heat resistant resin.

13. An electrophotographic apparatus according to claim 12, wherein said flexible resin has a hardness of 80 degrees or less, and said heat resistant resin has a heat distortion temperature of 80° C. or above.

14. A process cartridge comprising a contact charging member and an electrophotographic photosensitive member integrated into a cartridge detachable from the body of an image forming device, wherein said charging member has at least a supporting member and a coating member, said coating member being a seamless tube consisting of a resin blend of a flexible resin and a heat resistant resin.

15. A process cartridge according to claim 14, wherein said flexible resin has a hardness of 80 degrees or less, and said heat resistant resin has a heat distortion temperature of 80° C. or above.

* * * * *